United States Patent [19]

Walsh

[11] 4,309,059

[45] Jan. 5, 1982

[54] MINING METHOD

[76] Inventor: Myles A. Walsh, 143 N. Main St., Cranbury, N.J. 08512

[21] Appl. No.: 868,717

[22] Filed: Jan. 11, 1978

[51] Int. Cl.[3] ..... E21D 15/30

[52] U.S. Cl. ..... 299/11; 299/18; 299/19

[58] Field of Search ..... 299/11, 18, 19; 61/45 F

[56] References Cited

U.S. PATENT DOCUMENTS

| | | | |
|---|---|---|---|
| 2,990,166 | 6/1967 | Walsh | 299/11 |
| 3,980,342 | 9/1976 | Dunham | 299/56 |
| 4,021,076 | 5/1977 | Hawthorne | 299/56 |
| 4,056,939 | 11/1977 | Alvarez-Calderon | 299/11 |
| 4,072,015 | 2/1978 | Morrell | 299/11 |
| 4,072,018 | 2/1978 | Alvarez-Calderon | 299/11 |

FOREIGN PATENT DOCUMENTS

| | | | |
|---|---|---|---|
| 1069549 | 11/1959 | Fed. Rep. of Germany | 299/11 |
| 2415106 | 10/1975 | Fed. Rep. of Germany | 61/45 F |
| 2513387 | 9/1976 | Fed. Rep. of Germany | 299/11 |
| 381767 | 8/1973 | U.S.S.R. | 299/11 |

*Primary Examiner*—William F. Pate, III

*Attorney, Agent, or Firm*—Kenway & Jenney

[57] ABSTRACT

Improvements in the amount of ore receivable from a seam having an overburden and improvements in mine safety are achieved by strategically deploying inflated bladders for temporary overburden support and using certain bladders as forms for producing permanent support structures. An access wall is provided to an edge of the seam to be mined by forming a trench or tunnel; and, ore is mined by working into the access wall to produce a series of elongated, substantially parallel chambers. As each chamber is completed, its overburden is supported by inserting and inflating one or more bladders; and, caving of the access wall is prevented by installing a bladder at the mouth of the chamber. Because of the support, adjacent chambers may be quite close together, leaving only a thin rib of ore therebetween. When the work has progressed along the ore face, the inwardly disposed overburden supporting bladders in chambers remote from the newest excavation may be removed. The access wall supporting bladders are then filled, or the interior surfaces of the bladders are coated from within with a hardenable composition which is cured to provide a permanent support for the access wall and a dam to prevent and control the flow of water or noxious gases, facilitating backfilling of mined areas.

11 Claims, 6 Drawing Figures

MINING METHOD

BACKGROUND OF THE INVENTION

This invention relates to a method for increasing the ore yield and improving the working conditions in mines. More particularly, it relates to a mining method suitable for exploiting seams of coal, salt, potash, trona, oil shale, petroleum, tar sands, uranium, sand and gravel, talc, and the like, and to improvements in the mining method wherein a seam of ore having an overburden is exploited by excavating a series of elongate approximately parallel chambers in the seam.

It is now commonplace to mine seams of valuable minerals having an overburden by the "room and pillar" method. This involves digging out a trench, drift, bench, or tunnel to provide access to an edge of the seam and thereafter sequentially tunneling a series of chambers into the exposed access wall. Depending on the nature of the ore, the tunneling is conducted by workmen equipped with suitable mechanical devices, by a remotely controlled mechanical mole, or by employing mining augers of the type which operate by the same general principle as the carpenter's brace and bit. The latter method is well suited for mining friable ores such as coal, salt, potash, trona, and the like. The most significant drawback of this mining technique is that no inexpensive way has been forthcoming to prevent caving of both the excavated chambers and the ore face (access wall).

U.S. Pat. No. 2,990,166 to M. A. Walsh, entitled *Mining Method,* the disclosure of which is incorporated herein by reference, discloses one particularly advantageous and inexpensive method of temporarily supporting such chambers. As disclosed in the '166 patent, after a chamber is completed, an inflatable, flexible container or bladder is placed therein and inflated from a remote point such that it contacts at least the floor and ceiling of the chamber and supports the overburden. Since the overburden is supported, the next successive chamber may be excavated fairly closely adjacent the previously excavated chamber, leaving only a thin rib or pillar of material separating the two. After working a safe distance down the face of the access wall, the bladders contained in the chamber remote from the newest excavation are removed and caving is allowed to occur. Alternatively, caving may be induced by increasing and decreasing the pressure in the bladders.

While the foregoing method has many obvious advantages, it provides only temporary support, and removal of the bladders frequently results not only in caving of the chambers but also of the access wall. Usually, the access tunnel or trench must be maintained free of gob and in a structurally sound condition. Also, for reasons of safety and efficient utilization of conveying and mining equipment, it is frequently necessary to plug the openings between the access tunnel and the chambers to control flooding and the flow of noxious gases emanating from the excavated chambers. For these reasons, the access wall must often be permanently supported, for example, by being furnished with a suitable masonary structure located in the mouth of the opening. Obviously, this is a costly procedure and presents a potential hazard to the workmen building the structure.

SUMMARY OF THE INVENTION

The instant invention provides a unique and inexpensive method of both temporarily and permanently supporting excavated regions of a mine of the type discussed above, and enables significant improvements in the tonnage of ore which may be recovered from ore seams having an overburden too large or too inaccessible to be removed. The method comprises the steps of providing an access wall to the seam to be exploited, and thereafter tunneling into the ore from the access wall to produce a series of substantially parallel adjacent chambers, preferably traversing the entire width of the seam. As a chamber is completed, at least one inflatable flexible bladder is introduced therewithin and a second bladder is introduced into the mouth of the chamber adjacent the access wall. Both bladders are then inflated to support the overburden and prevent caving of the access wall. Because of the support provided by the bladders, the next successive chamber may be located relatively close to the previous chamber, and only a thin rib of ore need be left between chambers.

When a sufficient number of supported chambers have been constructed so that the men and machinery are now working in a location remote from previously formed chambers, the inwardly disposed bladders may be deflated and removed from the chambers for reuse. Alternatively, the inwardly disposed bladder may be pulled forward and reinflated at the mouth of the chamber. The inflated bladder disposed in the mouth of the chamber prevents collapse of the access wall and assures that the access tunnel or trench remains unobstructed as the work proceeds. Thereafter, it or a bladder which replaces it, as disclosed above, is employed as a form for producing a permanent access wall support structure from a hardenable, flowable material which is cured to seal the mouth of the chamber. The form may either be filled with the hardenable composition, or a coating of shotcrete or the like may be deposited on its interior surface to form a structurally adequate hollow support. Caving of the overburden into interior portions of the chamber may be allowed to occur spontaneously, or if desired, may be induced by pulsating the inwardly disposed bladder or bladders prior to their removal. Prior to permanently sealing the mouth of a chamber, access pipes for introducing hydraulic fill produced as waste in many types of mining operations can be placed between the bladder and chamber wall. Thus, the chambers may be used as convenient waste product depositories, which when filled hydraulically or pneumatically via the access pipes, reduce subsidence of the overburden and fill voids that could accumulate harmful (dangerous) (explosive) gases which might otherwise have to be ventilated at continuing cost to the mining operation.

The hardenable, flowable composition used to form the support structure may be any composition which can be pumped, sprayed, or pneumatically transported into the inflatable container and thereafter hardened or used to provide permanent structural support. Preferred compositions include quick hardening sludge, concrete compositions, foamed plastic materials, hydraulic mine fill or refuse produced in mining operations to which a hardener has been added. It will also be possible in some situations to spray quick curing compositions such as shotcrete on the interior surfaces of the bladders to form a hollow structural support. While the chambers may be mined by mechanical moles or the like as well as by suitably equipped miners, the process of the invention has particular utility in auger mining applications.

With most ore formations, the inflated bladders may be removed simply be deflating both the inwardly disposed bladder or bladders and the bladder adjacent the access wall, removing both from the chamber, repositioning and filling a bladder in the mouth of the chamber with a hardenable composition, curing the composition and allowing interior portions of the chamber to cave at some definite time thereafter.

In ore formations having caving tendencies, the inwardly disposed bladder need not be completely removed from the chamber, but when partially deflated, can be pulled forward to the position formerly occupied by the bladder at the mouth, pinched off if necessary, and used as a form. In rock formations wherein support is critically needed and its removal results in immediate caving, a specially designed access wall support bladder having an opening or conduit horizontally passing therethrough may be employed. The use of this type of bladder enables the inwardly disposed bladder to be collapsed and removed while maintaining support of the access wall. In extreme caving situations, the inwardly disposed bladder or bladders can simply be abandoned.

Accordingly, it is an object of the invention to provide a mining method which significantly improves the tonnage of ore recoverable from an ore seam of the type having an overburden too large or too inaccessable to be removed.

Another object of the invention is to provide a mining method suitable for exploiting seams of coal, salt, potash, oil shale, petroleum, tar sands, uranium, sand and gravel, talc, and the like.

Another object of the invention is to minimize the thickness of the pillars or ribs between chambers in a seam, thereby increasing the amount of ore that can be economically removed from an ore seam.

Another object of the invention is to reduce the cost of labor and materials normally associated with mining techniques of the type described above.

Still another object of the invention is to increase safety in open pit and underground mines by providing a means by which miners can remotely control, increase, or release the support of excavations or segments thereof, control subsidence as mechanical excavation progresses, or can induce systematic caving in mined out areas, thereby preventing unanticipated rock bursts and cave-ins.

Another object of the invention is to provide an inexpensive means for plugging excavations that are wet or gassy.

These and other objects and features of the invention will be apparent from the following description of a preferred embodiment and from the drawing.

DESCRIPTION OF THE PREFERRED EMBODIMENT

Figure 1:
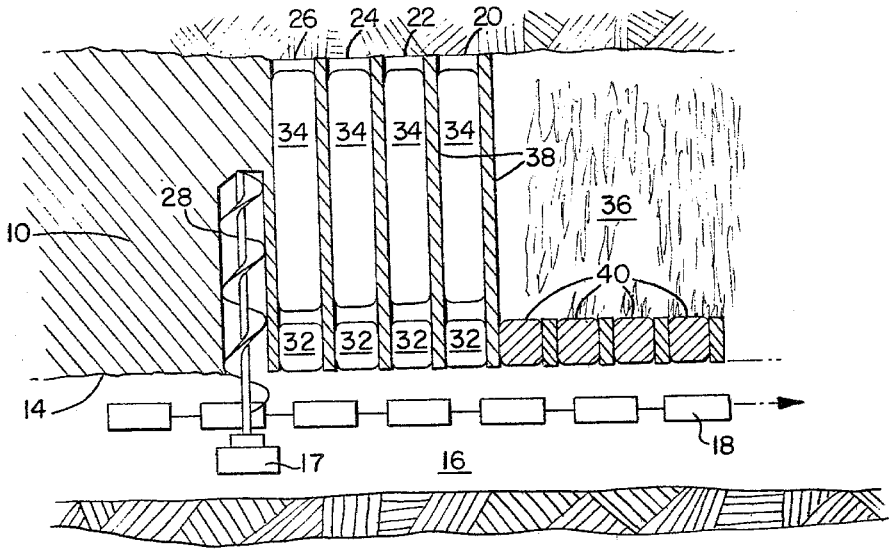
FIGS. 1, 2, and 3 are schematic plan views of an auger mining operation conducted in accordance with the process of the invention.

The invention in its broadest aspects is concerned with the provision of both temporary and permanent supports for the roof and walls of excavated chambers through the medium of flexible containers or bladders which are positioned to contact the rock surfaces of the excavations to be supported. The support required is supplied by inflating the bladders with a gas such as air under sufficient pressure to withstand the caving pressures. Surprisingly, it will usually be found that the degree of compression of the contained fluid may be kept relatively low. Frequently, a pressure of only two to three psig is required.

A primary object of the invention is to increase, as compared with the prior art techniques, the amount of coal or other ore that can be removed from a seam having an overburden and to do so both inexpensively and safely. This is accomplished by providing an access wall to the seam and working into the access wall face to produce a series of adjacent substantially parallel and typically elongate excavations or chambers. The height and width of the excavated chambers generally depend on the dimensions of the seam and on the particular method employed to remove the ore. Typically, the chambers are long and narrow, up to 1,000 feet in length, but usually between 100 and 200 feet in length and sometimes shorter. Such chambers can be tunneled using a mining auger, a remotely controlled mechanical robot or mole, or other mechanical device controlled by workmen. In general, the selected method of removing ore forms no part of the instant invention, although the process of the invention is well suited for use in auger mining efforts, and especially those employing a back reaming auger or a "square hole" auger which features eccentrically turning cutters that produce a square-like hole.

In order to optimize the quantity of ore taken out of the seam, it is obviously necessary to excavate successive chambers as close together as possible. However, because of the overburden, unless some form of temporary support is employed, the rib or pillar of ore separating adjacent excavations must be thick enough to support the roof. To enable successive excavations to be located closer together, inflatable bladders have been used to temporarily support previously excavated chambers while work is in progress on a new chamber. When the work has progressed a significant distance along the access wall, the bladder is simply deflated and removed, and the chamber it supported is allowed to cave.

While this technique has several obvious advantages, it also has two serious deficiencies. Specifically, it frequently, occurs that the access wall itself caves together with or shortly after the chamber roof. This has been troublesome since mine safety and the smooth operation of conveyors and the like usually depend on maintaining a clear access tunnel or trench. Also, it is frequently necessary to permanently seal or plug the chambers to control flooding and the flow of noxious gases and to maintain unpolluted airways. While the foregoing difficulties can be overcome by constructing a solid support at the mouth of the completed chamber, the cost of this procedure and the danger of a rock fall or a rock burst or the like during construction of the support render this alternative unacceptable.

In accordance with the invention, the foregoing difficulties are overcome by temporarily supporting each chamber with at least two inflated bladders, that is, one or more bladders disposed inwardly of the access wall to support the chamber overburden and one bladder located at the mouth of the chamber in supporting relation to the access wall itself. When the mining operation has moved a safe distance down the access wall, the inwardly disposed bladder is deflated and removed for reuse and the bladder supporting the access wall, acting as a form, is filled or the inside surface of the inflated bladder is coated by spraying with a flowable, hardenable composition such as a quick hardening sludge, concrete, foamed plastic material, hydraulic mine fill to which hardening additives have been applied, or the like. In this way, the bladder adjacent the access wall is used as a form to provide a permanent support and chamber plug. Shotcrete, or equivalent quick hardening material, is sometimes used to strengthen the surface of underground openings, but rock surfaces do not always easily accept the hardening coating because of oozing water or gas or because of a dust or slime coating. However, coating the inside surface of an inflated bladder by spraying shotcrete or the like through rotating pipe inserted through the end of the bladder obviates this problem.

The sequence of operations may be varied depending on the stability of the geological formation in the vicinity of the seam and on the nature of the ore itself. For example, in relatively stable locations, all bladders supporting a given chamber may be deflated and removed. Thereafter, an access wall supporting bladder is repositioned and used as a form for the hardenable composition. In situations where caving tendency is significant, the sequence of operations involves deflating and removing the inwardly disposed supporting bladders, for example, through a conduit traversing the bladder adjacent the access wall. This assures that the access wall will not collapse despite the fragility of the surrounding rock formation. There will also be situations where the most economical procedure is to simply abandon the inwardly disposed bladders.

For less fragile rock formations, it is possible to partially deflate and move an inwardly disposed bladder to the mouth of the chamber, pinch off a portion of the bladder to reduce its interior to a size suitable for use as a form, reinflate the bladder, and fill it with concrete or the like.

Referring to the drawing, the process of the invention is practiced in a seam of ore 10 having an overburden 12. To exploit the seam, an access wall 14 is provided by excavating a tunnel or trench 16 which provides working space for the excavating equipment 17, in the drawing illustrated as a mining auger, and a conveyor 18.

Figure 2:
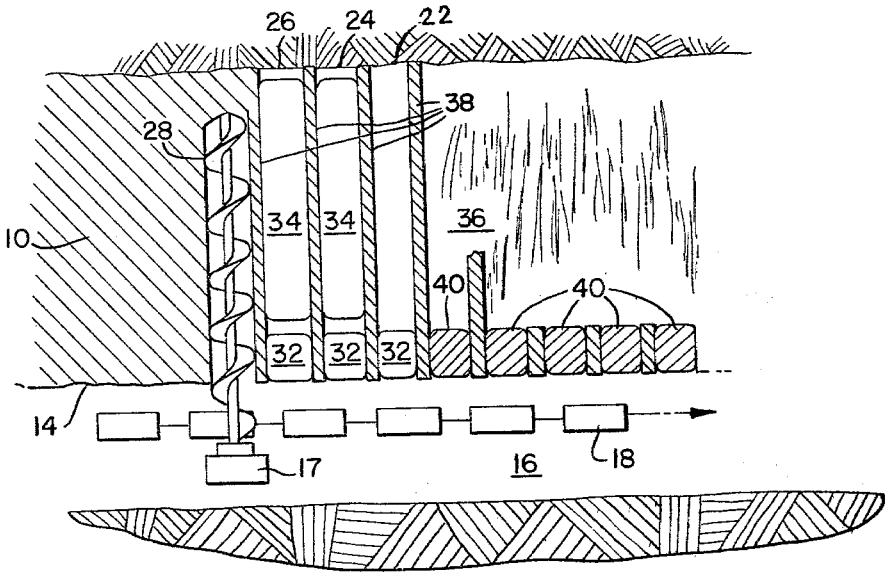
Figure 3:
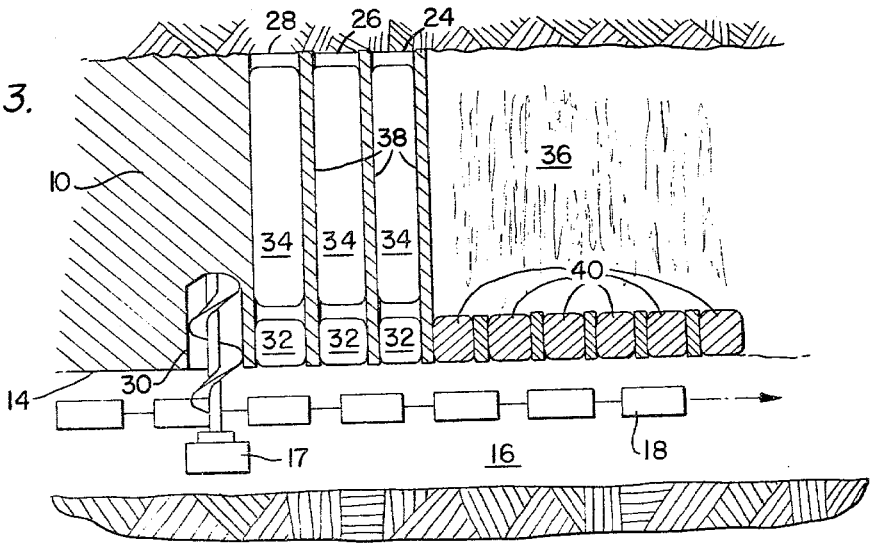

FIGS. 1, 2, and 3 illustrate the sequence of operation accordingly to the process of the invention. In FIG. 1, the mining auger is in the process of excavating a new chamber 28. Chambers 20, 22, 24, and 26 are each supported by an access wall supporting bladder 32 and an inwardly disposed overburden supporting bladder 34. Of course, depending on the length of chambers 20–26, more than one inwardly disposed overburden supporting bladder 34 may be used, and depending on the fragility of the overburden, these may vary in length and spacing. In this regard, the bladder size requirements are perhaps best provided by employing a tube of suitable gauge polyethylene or the like having a diameter equal to the chamber diameter which may be dispensed from a roll or the like, cut-off, and sealed by means of a pinch clamp or other means to make ideally sized bladders.

FIG. 2 illustrates the same mining operation as it appears a short time later. In FIG. 2, more progress has been made on the excavation of chamber 28, and the inwardly disposed overburden supporting bladders 34 which were located in chambers 20 and 22 have been removed. As illustrated, after removal of the supporting bladders 34 and filling of bladder 32 of chamber 20 to form a support, the roof and thin ribs of ore 38 are allowed to cave to form gob 36. However, because the access wall supporting bladder 32 and supports 40 maintain the area immediately adjacent access wall 14, this area remains intact.

In FIG. 3, chamber 28 has been completed and the next successive chamber 30 is being excavated. Chamber 28 is temporarily supported by a pair of inflated containers 32 and 34. Thus, the distance between chambers 26 and 28 may be small and the thickness of rib or pillar 38, which represents a loss, may be reduced. To permanently support the access walls 14 and to isolate the gob area 36 from access tunnel 16, the access wall supporting bladder 32 of chamber 22 is filled (or lined by spraying) with a concrete composition or the like and the composition is hardened to produce permanent supports 40.

Figure 4:
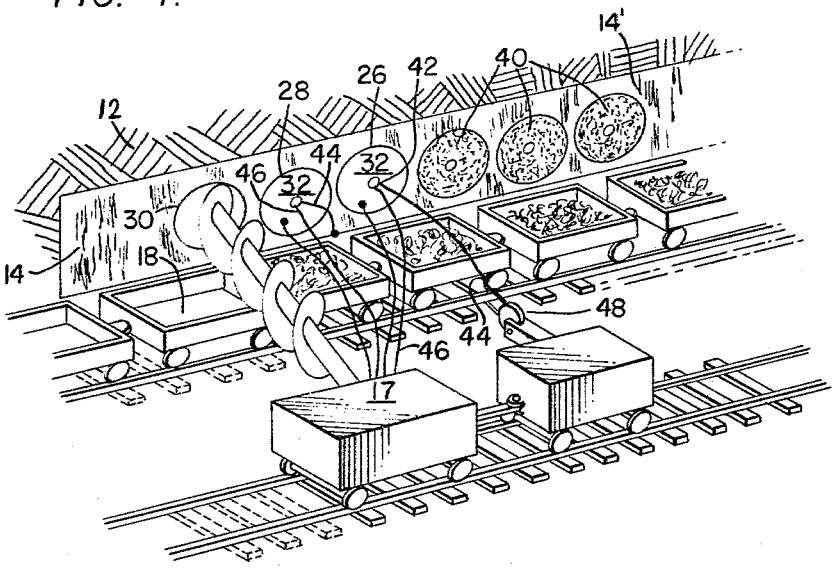
FIG. 4 is a fragmentary perspective view of an auger mining effort conducted in accordance with the process of the invention.

FIG. 4 represents a partially broken away perspective view of an auger mining operation illustrating certain aspects of an important embodiment of the process of the invention. As illustrated, the chambers remote from the chamber under excavation 30 have been permanently plugged and the access wall therearound 14' permanently supported by concrete supports 40. Before beginning excavation 30, chamber 26 is supported as illustrated in the top half of FIG. 5. Access wall supporting bladders 32 have a conduit 42 passing therethrough or alternatively, alongside (not shown), to provide communication with inflated bladder 34 (FIG. 5) disposed inwardly of the access wall 14. An extraction cable 44 for removing the inwardly disposed bladder or bladders and an air hose 46 for inflating and deflating the same pass through the conduit 42.

Figure 5:
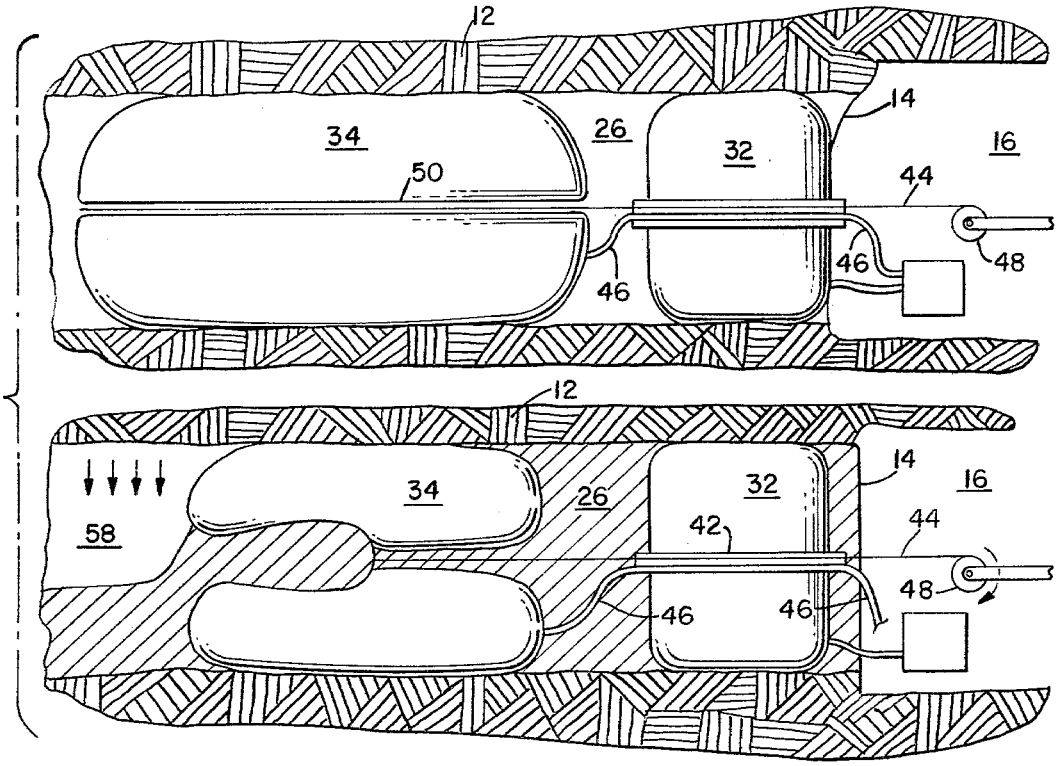
FIG. 5 is a cross section of a mined chamber illustrating the means of support provided in accordance with the process of the invention and one method of removing overburden supporting inflated bladders from an excavation.

As illustrated in FIG. 4 and 5, the inwardly disposed overburden supporting bladder 34 located in chamber 26 behind bladder 32 is withdrawn by winch 48 while air contained in the bladder 34 is allowed to escape via hose 46.

FIG. 5 disclosed one set-up for removing the inwardly disposed bladders 34 without even temporarily removing support from the region about the access wall 14. As shown, the container 34 has a convoluted opening 50 through which extraction cable 44 passes. When tension is applied to cable 44 such as by winch 48, inwardly disposed container 34 is retracted as shown in FIG. 5 and simultaneously deflated via hose 46. Continued pulling on the cable 44 completely deflates bladder 34, leaving an unsupported area 58 behind, and enables bladder 34 to be pulled through conduit 42 and recovered for reuse. Those skilled in the art will readily be able to produce other mechanisms for recovering the inwardly disposed bladders 34 in view of this specification.

Of course, a series of inwardly disposed bladders may be deployed and removed in a similar manner. Also, it will be a matter of choice to fill or line bladder 32 with a concrete composition or the like either before or after the removal of bladder 34. If leakage of gas or the like from the chamber into the access tunnel or trench 16 is to be prevented, conduit 42 may be sealed by any suitable means.

Figure 6:
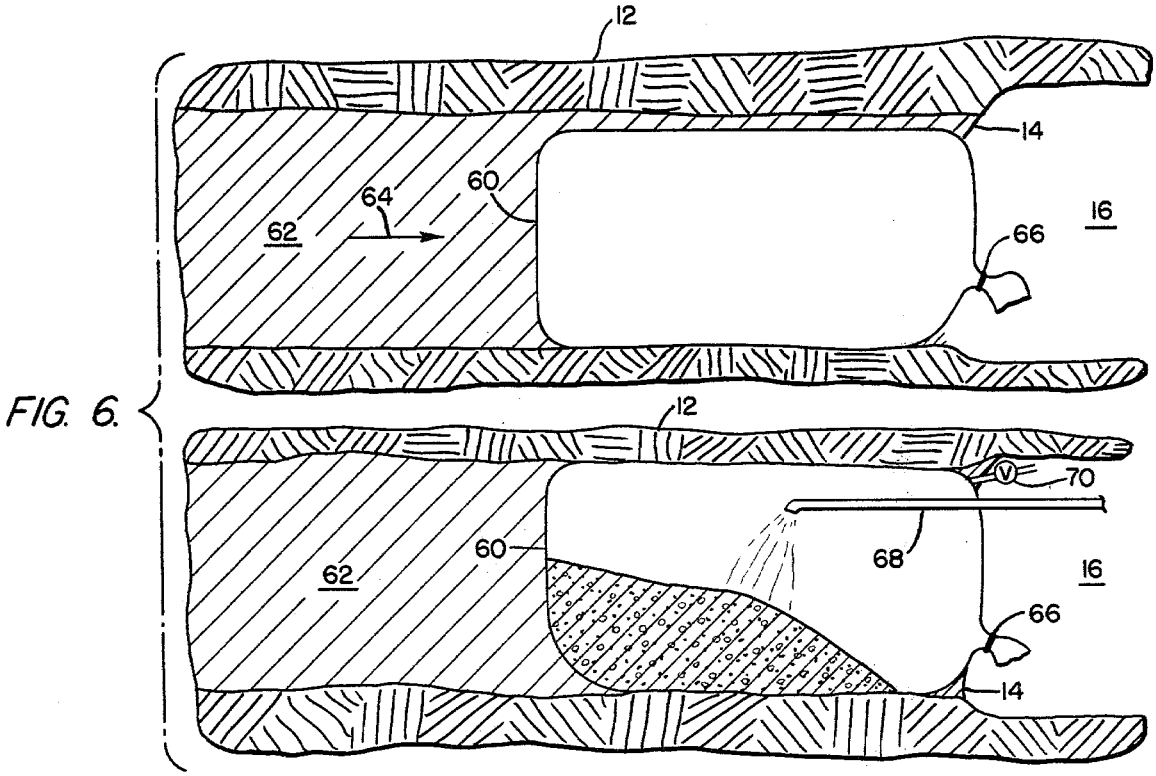
FIG. 6 is a cross section of the mouth of a chamber illustrating the formation of a quick drying concrete structural support.

Referring to FIG. 6, one method of employing a support bladder as a form is illustrated. A bladder 60, formerly disposed inwardly in chamber 62 as a temporary overburden support, is partially deflated as shown in the top half of FIG. 6 and moved forwardly in the direction of arrow 64 to the mouth of the chamber. In a semi-inflated position, the bladder is then pinched off (if necessary) such as by clamp 66. Necessary inlet and outlet fixtures are then applied by conventional techniques such as low temperature patching or grafting. For example, a hole can readily be formed at a convenient location and patched with an elastomeric fitting that will form a seal about a pipe inserted therethrough. Such procedures are facilitated by the fact that small leaks do not adversely affect the operation at this stage.

As shown in the bottom portion of FIG. 6, an injection pipe 68 and a relief valve 70 are installed adjacent the top of bladder 60. A flowable, hardenable composition is then forced into the bladder via injection-pipe 68. Pressure is maintained within the bladder by relief valve 70.

On the basis that the seam mined is bituminous coal and that auger 17 of FIGS. 1–4 drills circular holes four feet in diameter, for each 100-foot length of chamber excavated in the seam, about 52 tons of coal will be extracted. This coal production potential is expressed in the following table: Estimated Bituminous Coal From 4-foot Diameter Chamber

| Length of Chamber feet | Coal Production per Chamber short tons |
|---|---|
| 100 | 52 |
| 200 | 104 |
| 300 | 156 |
| 400 | 208 |
| 500 | 260 |
| 600 | 312 |
| 700 | 363 |
| 800 | 415 |
| 900 | 467 |
| 1,000 | 519 |

There is no limit to the number of chambers that can be mined, providing that the seam thickness and attitude are constant as indicated in the drawing and the tunnel or trench 16 is maintained open and safe by the process of the invention through strengthening and permanently supporting the access wall 14' by concrete filled or lined supports 40. In some instances, the number of chambers will be twice that indicated by FIGS. 1–4, since auger 17 in many situations can be used to penetrate the wall opposite access wall 14, augering in a direction 180° to that shown in the drawing (FIGS. 1–4).

The number of chambers excavated in parallel in a given seam length is of course a function of the thickness of the pillars or ribs 38 of FIGS. 1–3. The thinner the pillar, the greater the number of chambers per unit length of access wall 14. Also, needed support provided during augering by the overburden supporting bladder 34 makes smooth augering possible in spite of overburden pressures and enables deeper penetration into the seam than is otherwise possible. Without temporary support from bladder 34, the cutting head and auger flight stem are squeezed by overburden pressures which tend to close unsupported areas. In current augering practice, cutting heads are sometimes caught in the "squeeze" and are lost or must be salvaged at considerable expense and risk.

Accordingly, the invention makes possible the excavation of a greater number of chambers as well as longer chambers within a given volume of seam. Thus, substantially more ore production per linear unit of access wall is realized. The alternative to the above is the current practice wherein augering is done with pillars two to four times wider than those which result from the process of the invention and the augers are able to penetrate generally only about 150 feet and rarely deeper than 200 feet.

Thus, it can be seen that in accordance with the invention, substantially all the ore in a seam can be removed inexpensively and with greatly reduced danger of catastrophic cave-in or the like. The process of the invention is advantageous since all areas of the mine which pose threat to men or machinery in case of collapse may be supported at all times. The means of chamber support is light-weight, reusable, inexpensive, and may be quickly installed and removed from remote locations.

Furthermore, a simple and effective way of supporting the access wall and permanently plugging the excavated chambers is provided. The result is a safer, obstruction-free pit or mine tunnel, improvements in yield of the mine, and an upgrading in the ease of maintenance of air supplies for mine ventilation.

Furthermore, permanently plugging the mouths of excavated chambers with hardenable material, such as those of 40, FIGS. 1–4, establishes access wall 14' of FIG. 4 as a useful impermeable barrier or dam behind which it is possible to stow in the area of gob 36 hydraulic of pneumatic fill, such as sand, mine tailings, waste rock slurry, or waste from coal preparation plants. Closure of voids in gob 36 by this means has the beneficial effect of reducing subsidence of overburden 12, reducing underground pressures (forces) on access wall 14', making access tunnel or trench 16 a safer place for mine personnel, and also filling space in gob 36 which otherwise might accumulate noxious and/or explosive gases, or allow accumulation of mine waters, which spaces in active mines might otherwise have to be ventilated or drained continuously at considerable expense to operations. Provision for pipelines for filling behind the dam has been described above.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A mining method for improving the tonnage of ore recoverable from an ore seam having an overburden, said method comprising the steps of:

A. providing an access wall to the seam;

B. removing an elongate segment of the ore by working into the seam from the access wall to produce a chamber, supporting the overburden by introducing at least one inflatable, flexible bladder disposed inwardly within said chamber, supporting the access wall by introducing an inflatable, flexible bladder into the mouth of said chamber, and inflating the bladders;

C. serially repeating step B to produce a series of supported chambers substantially parallel to each other and separated by a thin rib of ore, the inflated bladders in said chambers enabling the next successive chamber to be formed closely adjacent the previously formed chamber;

D. at a chamber remote from the most recently formed chamber, employing a bladder adjacent the access wall as a form by forcing a flowable, hardenable composition therewithin, and hardening said composition to provide a support structure preventing collapse of said access wall; and E. serially repeating step D.

2. The process as set forth in claim 1 wherein the hardenable, flowable composition is selected from the group consisting of shotcrete, quick hardening sludge, concrete compositions, foamed plastic materials, and hardenable hydraulic mine fill.

3. The process as set forth in claim 1 wherein ore is removed to form said chambers by auger mining.

4. The process as set forth in claim 1 wherein said support structure is hollow.

5. The process as set forth in claim 1 comprising the further steps of removing the bladder from the mouth of a chamber remote from the most recently formed chamber prior to step D, partially deflating and withdrawing an inwardly disposed bladder to a point in supporting relation to said access wall, and employing at least a portion of said bladder as a form to provide a support structure for said access wall.

6. The process as set forth in claim 1 wherein an inwardly disposed bladder is abandoned within the chamber to act as a plug to arrest the flow of fluids therethrough.

7. The process as set forth in claim 1 wherein the access wall is a dam behind which mine workings are backfilled.

8. A mining method for improving the tonnage of ore recoverable from an ore seam having an overburden, said method comprising the steps of:

A. providing an access wall to the seam;

B. removing an elongate segment of the ore by working into the seam from the access wall to produce a chamber, supporting the overburden by introducing at least one inflatable, flexible bladder disposed inwardly within said chamber, supporting the access wall by introducing an inflatable, flexible bladder into the mouth of said chamber, and inflating the bladders;

C. serially repeating step B to produce a series of supported chambers substantially parallel to each other and separated by a thin rib of ore, the inflated bladders in said chambers enabling the next successive chamber to be formed closely adjacent the previously formed chamber;

D. at a chamber remote from the most recently formed chamber, removing the inwardly disposed inflatable bladder and employing the bladder adjacent the access wall as a form, forcing a flowable hardenable composition therewithin, and hardening said composition to provide a support structure preventing the collapse of said access wall; and, E. serially repeating step D.

9. The process as set forth in claim 8 wherein the inwardly disposed inflatable bladder is removed through a conduit traversing the inflated bladder adjacent the access wall so that the access wall support is maintained.

10. The process as set forth in claim 8 wherein the inwardly disposed inflatable bladder is removed by temporarily withdrawing the bladder adjacent the access wall, at least partially deflating the inwardly disposed bladder and withdrawing the inwardly disposed bladder from said chamber.

11. The process as set forth in claim 8 wherein the access wall includes both oppositely facing walls in an access tunnel in a mine.

* * * * *